US005975185A

United States Patent [19]

Miller et al.

[11] Patent Number: 5,975,185

[45] Date of Patent: Nov. 2, 1999

[54] POP UP SAFETY DEVICE FOR ROLLING SHUTTERS

[75] Inventors: James V. Miller, Glen Ellyn; Garrett C. Waecker, Des Plaines, both of Ill.

[73] Assignee: QMI Roll Shutter Supply, Elmhurst, Ill.

[21] Appl. No.: 09/129,530

[22] Filed: Aug. 5, 1998

[51] Int. Cl.[6] ..... E06B 9/56

[52] U.S. Cl. ..... 160/310; 74/625

[58] Field of Search ..... 160/310, 311, 160/188, 189, 133, 9, 312; 74/625

[56] References Cited

U.S. PATENT DOCUMENTS

| | | | |
|---|---|---|---|
| 3,739,832 | 6/1973 | Sivin | 160/133 |
| 4,060,310 | 11/1977 | Brown | 160/310 X |
| 4,392,392 | 7/1983 | Perisic et al. | 74/626 |
| 4,417,185 | 11/1983 | Bullat | 318/2 |
| 4,721,146 | 1/1988 | Wardlaw | 160/310 |
| 4,727,919 | 3/1988 | Kraeutler | 160/84 |
| 4,844,140 | 7/1989 | Jones et al. | 160/310 |
| 4,850,418 | 7/1989 | Bresson | 160/310 |
| 4,974,658 | 12/1990 | Komatsu et al. | 160/310 |
| 4,976,168 | 12/1990 | Lotznicker et al. | 74/625 |
| 5,040,843 | 8/1991 | Russell et al. | 74/625 X |
| 5,083,600 | 1/1992 | Weishar et al. | 160/310 |
| 5,447,477 | 9/1995 | Bresson et al. | 475/154 |
| 5,711,360 | 1/1998 | Viotte | 160/310 |

*Primary Examiner*—Daniel M. Purol

*Attorney, Agent, or Firm*—Marshall, O'Toole, Gerstein, Murray & Borun

[57] ABSTRACT

The present invention is directed to a modular roll-up partition assembly, such as a rolling protective shutter, implementing an improved mechanism for raising the partition in an emergency by disengaging a motor from a rolling shutter. The mechanism includes a cable that passes through an axial passage in a spring shaft to which a torsion spring is mounted. When the cable is pulled, the coupling mechanism is separated from the motor drive shaft, thereby disengaging the spring shaft from the motor drive shaft and permitting the torsion spring to quickly raise the rolling shutter.

16 Claims, 3 Drawing Sheets

POP UP SAFETY DEVICE FOR ROLLING SHUTTERS

BACKGROUND OF THE INVENTION

The present invention is directed to a roll-up partition system assembly which has a protective partition for covering a window or door opening that may be rolled up into a housing when not in use. More particularly, the present invention is directed to a modular assembly implementing an improved emergency opening mechanism for roll-up partition systems. The embodiments disclosed herein illustrated the various aspects of the present invention applied to one particular type of roll-up partition system: rolling protective shutters formed from a plurality of interconnected slats. It will be apparent to those of ordinary skill in the art that the present invention has application in other systems wherein a partition member is coupled to and rolls up onto a support member within a housing, such as roll-up doors, roll-up grills, roll-up gates and the like. The application of the present invention to the various types of roll-up partition systems is contemplated by the inventor.

One type of roll-up partition system is a rolling protective shutter. Rolling protective shutters are conventional and are used to provide protection against extreme weather conditions and to deter theft, for example. One such rolling protective shutter is disclosed in U.S. Pat. No. 4,345,635 to Solomon. As shown in FIGS. 1 and 2 of that patent, the Solomon shutter is composed of a plurality of elongate slats, each of which has a pair of circular ribs attached to its sides. The slats are interconnected by a plurality of elongate hinges, each of which has a pair of circular apertures in which the circular ribs of the slats are disposed. When the Solomon shutter is unrolled to its protective position, each of the slats in the shutter is disposed vertically with the ends of the slats disposed within guide channels or side tracks on either side of the opening. When not in use, the Solomon shutter may be rolled up into a housing disposed at the upper end of the protective shutter.

Another type of rolling protective shutter is disclosed in U.S. Pat. No. 5,575,322 to Miller. As shown, the shutter assembly includes a shutter support member mounted for rotation in a shutter housing. A rolling shutter composed of a plurality of individual slats is coupled to the shutter support member so that the shutter can be rolled up onto the shutter support member. A pair of shutter tracks extend downwardly from either end of the shutter housing. When the shutter is in its unrolled position, the ends of the slats are disposed within the tracks.

Roll-up partitions in general, and rolling protective shutters in particular, typically incorporate one or more torsion spring assemblies to assist in rolling and unrolling the shutters manually or by a powered opening device. In one arrangement, the assembly is a self-contained modular unit having a spring shaft surrounded by a coiled torsion spring. One end of the spring shaft includes a spring shaft support that is rotatable about the spring shaft, and a spring plate rigidly fixed to the spring shaft and to the proximate end of the torsion spring to prevent rotation of the end of the torsion spring relative to the spring shaft. The other end of the spring shaft includes a spring drive that is rotatable about the spring shaft and rigidly fixed to the other end of the torsion spring. The assembly is inserted into the shutter support member with one end of the spring rigidly fixed to the shutter housing. The spring shaft support and spring drive engage the interior of and rotate with the shutter support member. When the shutter is unrolled, the torsion spring is wound tighter, thereby providing additional torque to assist in lifting and rolling the shutter onto the shutter support member. During normal operation of the rolling protective shutters, the torsion spring exerts a minimum torque when the shutter is in the rolled position and a maximum torque when the shutter is in the unrolled position.

The torsion spring therefore assists in lifting the shutter to an open position, whether motor driven or manually operated. In many municipalities, it is required that a person could easily pull a lever and have any type of security door or gate open ("pop up") for easy and fast egress in case of an emergency, such as, for example, a fire, inside the building on which the security door or gate is installed. This "pop up" operation must be done mechanically rather than by electrical power, in the event that electrical power is interrupted due to the fire or other emergency in the building.

Accordingly, it is necessary to have a system that enables a torsion spring to raise the door or gate by a manual operation. Typically, motor driven security doors or gates use a braking system of some type to maintain the position of the door or gate when the motor is stopped. This braking system must be disengaged when the door or gate needs to be raised.

A typical type of overhead door uses a large motor mounted outside of a housing that contains the door or gate when it is rolled up. The motor can be hidden in the ceiling of the building in which the door or gate is installed. Through the use of gears and/or chains, it has been fairly easy to provide a mechanism to disengage the braking system and permit the torsion spring to raise the shutter. However, this type of external motor system is extremely costly, very large, difficult to install, and can be unsightly if it cannot be hidden in a ceiling.

One primary alternative to such external motor systems is the use of tubular motors to raise and lower doors and gates. Tubular motors can be encased inside of a roller tube around which the door or gate is wound when the door or gate is opened. As the motor system is always hidden within the roller tube, it is never visible and thereby gives the door or gate a very clean look. The use of a tubular motor also makes installation of the door or gate much simpler.

Present designs for rolling doors or gates having tubular motors do not have satisfactory mechanisms for utilizing a torsion spring to raise the door in an emergency. Typically, a cable mechanism is used to manually release a brake inside the tubular motor. Such cable mechanisms do not work well in practice because the required travel of the cable is so small in order to effectively release the brake that the cable mechanisms either simply do not work or are extremely difficult to install properly. Accordingly, presently there are no known commercial manufacturers of tubular motors that offer a system for rolling up a door or gate in an emergency.

In view of the foregoing problems and disadvantages, there is a need for a system that can be used with a tubular motor that enables the use of a torsion spring to open a door or gate in case of an emergency.

Summary of the Invention

The present invention is directed to a roll-up partition assembly, such as a rolling protective shutter, implementing an improved mechanism for opening the partition assembly in an emergency situation.

In accordance with a preferred embodiment of the present invention, a mechanism is provided for disengaging a motor from a roller tube of a rolling shutter. The mechanism includes a manually operable actuating member that passes through an axial passage in a spring shaft to which a torsion spring is mounted. The manually operable actuating member is connected to a coupling mechanism. When the manually operable actuating member is pulled, the coupling mechanism is separated from the motor drive shaft, thereby disengaging the roller tube from the motor drive shaft.

The features and advantages of the invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
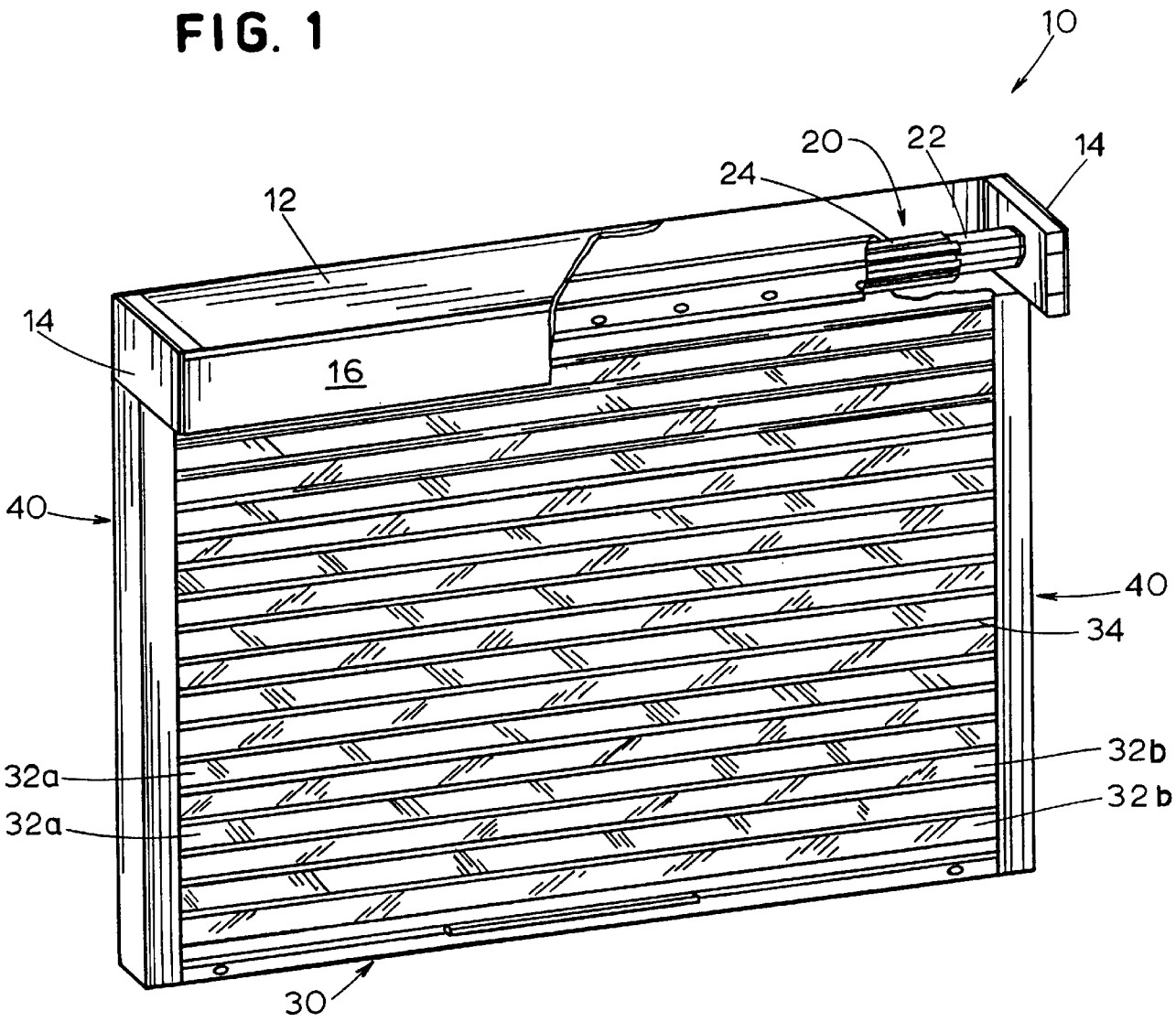
FIG. 1 is a perspective view of a rolling shutter assembly that can implement the present invention.
Figure 2:
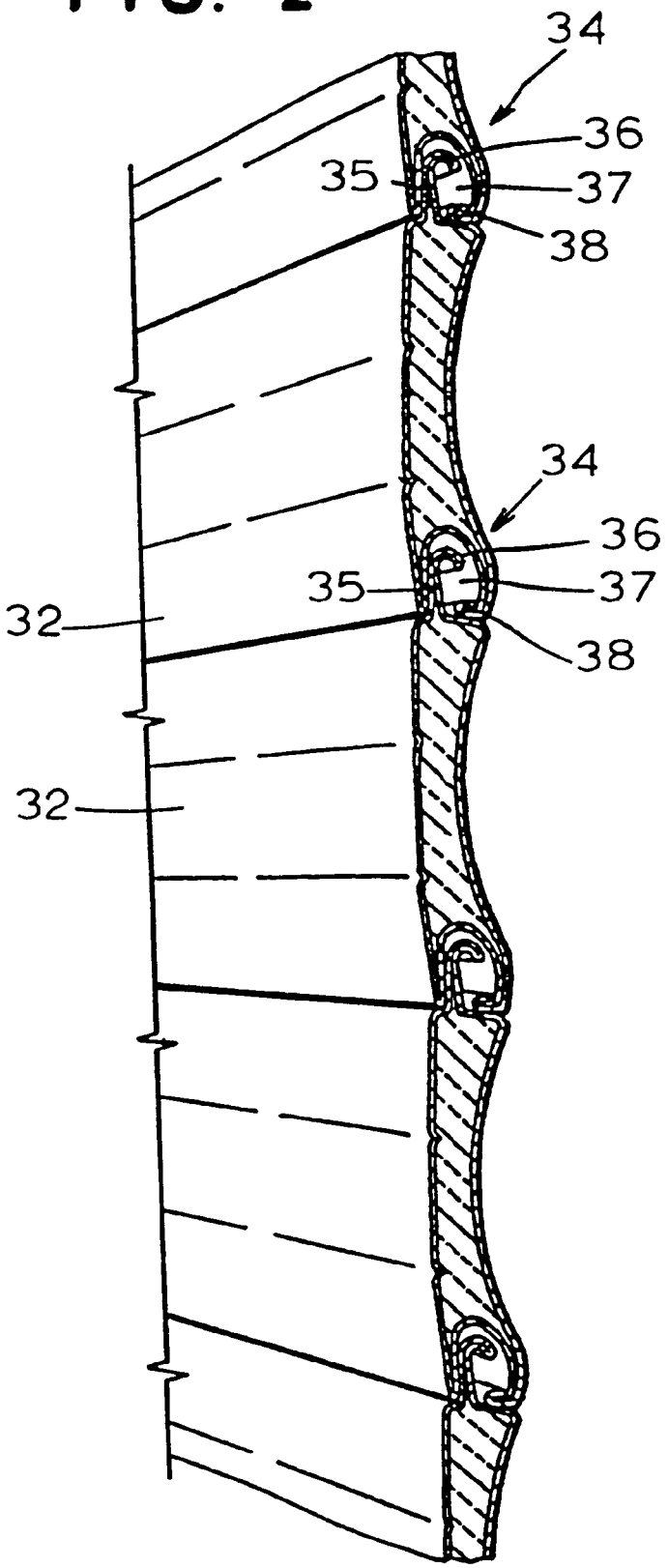
FIG. 2 is a fragmentary perspective view of a portion of the shutter of the shutter assembly of FIG. 1.
Figure 3:
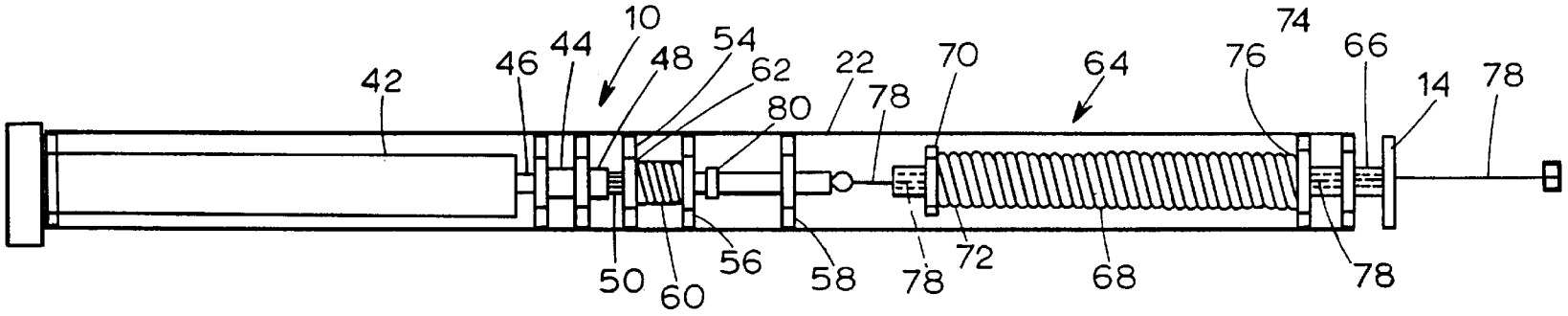
FIG. 3 is a schematic top view of a portion of the shutter assembly of FIG. 1, in a configuration for normal, motorized operation.

One type of roll-up partition system, rolling shutter assembly 10, that may implement the present invention is shown in FIGS. 1–3. Referring to FIG. 1, the shutter assembly 10 has a shutter housing which includes a top wall 12, a pair of side walls 14, and a front wall 16. A partition support member 20 is mounted for rotation within the shutter housing. The support member 20 includes a generally cylindrical central roller tube 22 and a plurality of mounting members 24 fixed to the roller tube 22.

The upper end of a rolling shutter 30 is coupled to the mounting members 24. Alternatively, however, the mounting members 24 may be omitted and the rolling shutter 30 mounted directly to the roller tube 22. The shutter 30 is composed of a plurality of individual, elongate slats 32. One example of a configuration of slats 32 is illustrated in FIG. 2. The slats 32, each of which is substantially flat, having two substantially planar side portions, and may be composed of steel, are interconnected by a plurality of hinges 34, each of which joins together a pair of adjacent slats 32.

Each of the slats 32 includes an upward projection 35 extending longitudinally along the upper edge of the slat 32 and having a rearwardly and downwardly extending hook 36 at the top. Each of the slats 32 further includes a downward facing U-shaped recess 37 extending longitudinally along the lower edge of the slat 32 and having a forward horizontal projection 38 formed on the rear edge of the recess 37. The hook 36 of a lower slat 32 and the recess 37 and projection 38 of an upper slat 32 interlock to form each hinge 34.

Instead of being integrally formed with the shutter slats 32, the hooks 36 and U-shaped recesses 37 described above could be separate components connected thereto, such as by bolting or riveting. Instead of hooks and recesses, other locking members having different structures could be used to form the hinges. Other configurations of slats 32 and interconnecting hinges 34, such as the configuration of the Solomon shutters, are well known in the art and are contemplated by the inventor as having use with the present invention.

Referring back to FIG. 1, the ends of the slats 32 are disposed within a pair of shutter tracks 40. When mounted to protect a window or other opening, the shutter tracks 40 of the shutter assembly 10 are positioned on either side of the opening and the shutter housing is positioned over the top of the opening. Alternatively, in some applications, the side tracks 40 and shutter housing are positioned within the opening.

The shutter assembly 10 includes a tubular electric motor 42 (shown schematically in FIGS. 3 and 4) disposed within the roller tube 22. When the shutter 30 is not in use, it is rolled up on the roller tube 22 via the motor 42 so that it is at least partially enclosed by the shutter housing.

Figure 4:
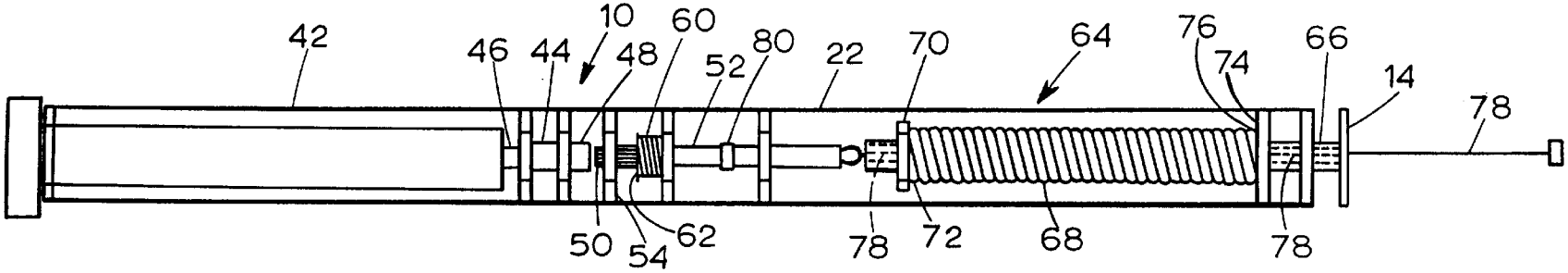
FIG. 4 is a schematic top view of a portion of the shutter assembly of FIG. 1, in a configuration for emergency, manual operation.

Now referring to FIGS. 3 and 4, the motor 42 is directly coupled to the roller tube 22, on which the shutter rolls up, by means of a motor drive coupling 44 driven by a motor shaft 46 extending from the motor 42. The motor drive coupling includes a splined socket portion 48 that mates with a splined end portion 50 of an axially movable drive shaft 52. The splined end portion 50 also mates with a splined drive plate 54 that is fixedly secured to the roller tube 22 for rotation therewith. The axially movable drive shaft 52 passes through a first spacer plate 56 and a second spacer plate 58. A compression spring 60 wrapped around the axially movable drive shaft 52 is disposed between the first spacer plate 56 and a compression spring plate 62 that is fixed to the axially movable drive shaft 52. The compression spring 60 tends to press the axially movable drive shaft 52 toward the left as shown in FIG. 3, and thus tends to press the splined end portion 50 of the movable drive shaft 52 into engagement with the splined socket portion 48 of the motor drive coupling 44.

As previously discussed, roll-up partition assemblies incorporate torsion springs to assist in lifting and rolling the shutters. Referring to the right hand portion of FIGS. 3 and 4, the shutter assembly 10 includes a torsion spring assembly 64 that facilitates ease of movement of the shutter 30 from the unrolled position to the rolled position. The torsion spring assembly 64 includes a hollow spring shaft 66 surrounded by a coiled torsion spring 68 disposed within the roller tube 22. The hollow spring shaft 66 is anchored to the side wall 14 on the right hand side of the rolling shutter assembly 10.

A torsion spring plate 70 is rigidly mounted to the hollow spring shaft 66. The outer diameter of the torsion spring plate 70 is small enough to allow the roller tube 22 to rotate relative to the hollow spring shaft 66 without engaging the outer surface of the torsion spring plate 70. The torsion spring plate 70 is rigidly connected to a first end 72 of the coiled torsion spring 68 to prevent rotation of the first end 72 of the coiled torsion spring 68 relative to the hollow spring shaft 66.

The counterbalancing mechanism further includes a spring drive 74 rotatably mounted to the hollow spring shaft 66 adjacent a second end 76 of the coiled torsion spring 68 opposite the first end 72 thereof. The spring drive 74 is rigidly attached to the roller tube 22 for rotation therewith. The second end 76 of the coiled torsion spring 68 is coupled to the spring drive 74 and rotates with the roller tube 22 relative to the hollow spring shaft 66. When the rolling shutter 30 is unrolled, the coiled torsion spring 68 is wound tighter as the second end 76 connected to the spring drive 74 rotates relative to the first end 72 connected to the torsion spring plate 70, thereby providing additional torque to assist in lifting and rolling the shutter 30 onto the roller tube 22.

A manually operable actuating member 78 passes through the hollow spring shaft 66 and is connected to the axially movable drive shaft 52. A bearing 80 is disposed between the manually operable actuating member 78 and the axially movable drive shaft 52, to prevent twisting of the manually operable actuating member 78 when the roller tube 22 and the axially movable drive shaft 52 are rotated to raise or lower the shutter 30. The manually operable actuating member 78 can be in the form of a flexible steel cable or a rigid metal rod. When the manually operable actuating member 78 is pulled, the compression spring 60 is compressed and the axially movable drive shaft 52 is moved toward the right, as seen in FIG. 4, disengaging the axially movable drive shaft 52 from the splined socket portion 48. Once disengaged from the splined socket portion 48, the axially movable drive shaft 52 is disconnected from the motor 42, permitting the torsion spring assembly 64 to raise the rolling shutter 30 without having to overcome the torque required to turn the motor 42. The manually operable actuating member 78 may then be released after the shutter 30 has been raised using the torsion spring assembly 64.

Once the manually operable actuating member 78 is released, the compression spring 60 presses the axially movable drive shaft 52 toward the left, as seen in FIG. 3, re-engaging the axially movable drive shaft 52 to the splined socket portion 48. The rolling shutter assembly 10, is therefore ready to be operated using the motor 42.

The embodiments disclosed herein illustrate the various aspects of the present invention applied to a rolling protective shutter. It will be apparent to those skilled in the art that the present invention may be applied to other systems wherein a partition member is coupled to a support member and rolled up into a housing. Such partition systems include roll-up doors, roll-up grills, roll-up gates and the like. The application of the present invention to the various types of roll-up partition systems is contemplated by the inventor.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An apparatus for disengaging a motor-driven overhead door for raising the door, comprising:

a motor having a drive shaft;

a rotatable partition support member;

a spring shaft having an axial passage; and means for selectively coupling said partition support member to said drive shaft for rotation therewith;

said selectively coupling means comprising an actuating member at least partially passing through said axial passage;

wherein, said actuating member is adapted to move from a first position at which said partition support member is coupled to said drive shaft for rotation therewith, and a second position at which said partition support member is uncoupled from said drive shaft.

2. The apparatus of claim 1, wherein said actuating member comprises a steel cable.

3. The apparatus of claim 1, wherein said actuating member comprises a metal rod.

4. The apparatus of claim 1, further comprising a bearing mounted between said drive shaft and said actuating member, said bearing substantially preventing twisting of said actuating member due to rotation of said drive shaft.

5. An apparatus for disengaging a motor-driven overhead door for raising the door, comprising:

a rotatable partition support member;

a motor disposed within said partition support member and having a drive shaft;

a spring shaft having an axial passage; and means for selectively coupling said partition support member to said drive shaft for rotation therewith;

said selectively coupling means comprising an actuating member at least partially passing through said axial passage;

wherein, said actuating member is adapted to move from a first position at which said partition support member is coupled to said drive shaft for rotation therewith, and a second position at which said partition support member is uncoupled from said drive shaft.

6. The apparatus of claim 5, wherein said actuating member comprises a steel cable.

7. The apparatus of claim 5, wherein said actuating member comprises a metal rod.

8. The apparatus of claim 5, further comprising a bearing mounted between said drive shaft and said actuating member, said bearing substantially preventing twisting of said actuating member due to rotation of said drive shaft.

9. A roll-up partition assembly, comprising:

a partition support member;

a partition member coupled to said partition support member;

a pair of side tracks;

a tubular motor disposed within said partition support member and having a drive shaft;

a spring shaft disposed within and coaxial with said partition support member;

a torsion spring disposed between said spring shaft and said partition support member and having a first end coupled to said spring shaft and a second end coupled to said partition support member;

means for selectively coupling said partition support member to said drive shaft for rotation therewith;

said selectively coupling means comprising an actuating member at least partially passing through said axial passage;

wherein, said actuating member is adapted to move from a first position at which said partition support member is coupled to said drive shaft for rotation therewith, and a second position at which said partition support member is uncoupled from said drive shaft.

10. The apparatus of claim 9, wherein said actuating member comprises a steel cable.

11. The apparatus of claim 9, wherein said actuating member comprises a metal rod.

12. The apparatus of claim 9, further comprising a bearing mounted between said drive shaft and said actuating member, said bearing substantially preventing twisting of said actuating member due to rotation of said drive shaft.

13. An apparatus for disengaging a motor-driven overhead door for raising the door, comprising:

a motor having a drive shaft;

a rotatable partition support member;

a spring shaft having an axial passage; and a coupling mechanism for selectively mating said partition support member to said drive shaft for rotation therewith;

said coupling mechanism comprising an actuating member at least partially passing through said axial passage;

wherein, said actuating member is adapted to move from a first position at which said partition support member is mated to said drive shaft for rotation therewith, and a second position at which said partition support member is disconnected from said drive shaft.

14. The apparatus of claim 13, wherein said actuating member comprises a steel cable.

15. The apparatus of claim 13, wherein said actuating member comprises a metal rod.

16. The apparatus of claim 13, further comprising a bearing mounted between said drive shaft and said actuating member, said bearing substantially preventing twisting of said actuating member due to rotation of said drive shaft.

* * * * *